US009345300B2

(12) United States Patent
Park

(10) Patent No.: US 9,345,300 B2
(45) Date of Patent: May 24, 2016

(54) BAG WITH ANTI-THEFT FUNCTION CROSS REFERENCE TO RELATED APPLICATION

(71) Applicant: Sang Il Park, Gyeonggi-do (KR)

(72) Inventor: Sang Il Park, Gyeonggi-do (KR)

( * ) Notice: Subject to any disclaimer, the term of this patent is extended or adjusted under 35 U.S.C. 154(b) by 119 days.

(21) Appl. No.: 14/297,560

(22) Filed: Jun. 5, 2014

(65) Prior Publication Data

US 2015/0351513 A1 Dec. 10, 2015

(51) Int. Cl.
*G08B 13/14* (2006.01)
*A45C 13/18* (2006.01)

(52) U.S. Cl.
CPC ..... *A45C 13/18* (2013.01); *G08B 13/14* (2013.01); *G08B 13/149* (2013.01)

(58) Field of Classification Search
CPC ..... A45C 13/18; A45C 13/20; A45C 1/04; A45C 3/06; A45C 13/185; G08B 13/14; G08B 25/016; G08B 13/22; G08B 25/10; G08B 13/08; G08B 13/00; G08B 13/02; G08B 25/008; G08B 13/149; G08B 13/1463; A45F 3/02; Y10T 70/5053; Y10T 70/5049
USPC ..... 340/568.1, 568.7, 541, 546, 545.6, 571; 105/102; 109/31, 38, 44
See application file for complete search history.

(56) References Cited

U.S. PATENT DOCUMENTS 4,755,802 A * 7/1988 Urbanczyk ..... A45C 13/24 116/84
7,064,667 B2 * 6/2006 Sosna ..... G08B 25/016 340/541
7,385,507 B2 * 6/2008 Simpson ..... G08B 5/00 109/29
7,979,964 B2 * 7/2011 Jans ..... A44B 19/301 24/386
2012/0125494 A1 * 5/2012 Avganim ..... A45C 13/20 150/101

* cited by examiner

*Primary Examiner* — Anh V La
(74) *Attorney, Agent, or Firm* — John K. Park; Park Law Firm

(57) ABSTRACT

Disclosed herein is a bag with an anti-theft function which is used to temporarily store various valuables (a wallet, a cellular phone, a camera, a watch, etc.) or clothes in a crowded place, for example, a water play area such as a beach or a water park, and is configured such that the stored valuables or the bag itself can be prevented from being stolen. The bag according to the present invention includes an anti-theft device which fastens first and second zippers that openably close an opening of the bag body to each other and binds the bag body to a surrounding structure, whereby valuables (a wallet, a cellular phone, a camera, a watch, etc.) stored in the bag body not only can be prevented from being stolen but the bag itself can also be prevented from being stolen because it is bound to the surrounding structure.

2 Claims, 9 Drawing Sheets

(a)

(b)

(a)

(b)

unlocking (a)

locking (b)

(a)

(b)

(a)

(b)

BAG WITH ANTI-THEFT FUNCTION CROSS REFERENCE TO RELATED APPLICATION

RELATED APPLICATIONS

This application claims the benefit of Korean Utility Model Application No. 20-2013-0007963, filed on Sep. 26, 2013, entitled "BAG WITH ANTI-THEFT FUNCTION", which is hereby incorporated by reference in its entirety into this application.

BACKGROUND OF THE INVENTION

1. Field of the Invention

The present invention relates generally to bags with anti-theft functions and, more particularly, to a bag with an anti-theft function which is used to store various articles and, especially, temporarily store valuables (a wallet, a cellular phone, a camera, a watch, etc.) in a crowded place, for example, an airport waiting room, a water play area such as a beach or a water park, etc., and is configured such that the stored valuables or the bag itself can be prevented from being stolen.

2. Description of the Related Art

Generally, in water play areas such as beaches or water parks which are crowded, bags for water play are used with the purpose of temporarily storing various kinds of valuables (wallets, cellular phones, cameras, watches, clothes, etc.) while users play in the water.

Given the purpose of storing various kinds of valuables, such bags for water play are waterproofed on inner or outer surfaces thereof to prevent water from entering the bags. Moreover, bags for water play are preferably provided with a safety device to minimize the risk of being lost or stolen.

However, bags for water play are made of light synthetic resin, because they must be superior in portability given the purpose for use. Therefore, there is a certain limit to the application of an existing anti-theft device for typical bags used for water play environments.

For example, a bag locking device which can be used as a bag for water play was proposed in Korean Patent Registration No. 10-0527165 (Registration date: Nov. 1, 2005). The bag locking device of No. 10-0527165 is applied to a bag which includes a bag body that defines a storage space therein and is provided with a zipper. The bag locking devices includes a pair of coupling holes which are formed in a bag body on symmetrical opposite sides of the zipper at a position adjacent to a slider of the zipper when the zipper is closed, and a locking means which is bound to the bag body through the coupling holes so as to restrict the movement of the slider and maintain the closed state of the zipper. With a relatively simple structure, the zipper provided on the opening of the bag can be closed and the storage space can be locked. Therefore, the bag is convenient to use and handle and can be produced at low cost.

As such, the bag locking device of No. 10-0527165 has a structure capable of locking the zipper that openably closes the opening of the bag. The separate locking means locks the zipper to prevent an unauthorized person from opening the bag. Thus, this conventional device can somewhat prevent valuables stored in the bag from being stolen. However, this conventional device is problematic in that there is no means for preventing an unauthorized person from fleeing with the whole bag without attempting to open the bag.

Particularly, in water play areas such as beaches or water parks, users often leave bags for water play, e.g., around lounge chairs or other places. Therefore, an event in which an unauthorized person flees with the whole bag frequently occurs. Given the case where an unauthorized person flees with the whole bag, the bag locking device of No. 10-0527165 that has the structure capable of locking only the zipper cannot completely prevent bag theft.

In an effort to overcome the above problems, techniques for preventing the whole bags from being stolen were proposed in Korean Patent Publication No. 10-1992-0016056 (Publication date: Sep. 24, 1992), Korean Utility Model Publication No. 20-1996-0000243 (Publication date: Jan. 17, 1996), and Korean Patent Publication No. 10-1998-0000250 (Publication date: Mar. 30, 1998). In these conventional techniques, a wireless remote control means is used in such a way that in emergency conditions, a user remotely operates a shock generation device using a remote control transmitter, or when the bag moves away from the remote control transmitter by a predetermined distance, the shock generation device is automatically operated, thus helping the user recover the bag that has been stolen.

However, in the conventional techniques which use anti-theft electronic devices, e.g., having an alarm generation function, the anti-theft electronic devices are typically installed on the bags with being exposed to the outside. Therefore, it is substantially difficult for these techniques to be applied to bags for water play. That is, in places where the bags for water play are placed, there is a lot of water or moisture to which electronic devices are prone to be damaged. If the bags with the conventional anti-theft electronic devices are placed in places where a lot of water or moisture is present, the anti-theft electronic devices may malfunction because water or moisture permeates electronic circuits.

PRIOR ART DOCUMENT

Patent Document (Patent document 1) KR 10-0527165 B1, Nov. 1, 2005
(Patent document 2) KR 10-1992-0016056 A, Sep. 24, 1992
(Patent document 3) KR 20-1996-0000243 U, Jan. 17, 1996
(Patent document 4) KR 10-1998-0000250 A, Mar. 30, 1998

SUMMARY OF THE INVENTION

Accordingly, the present invention has been made keeping in mind the above problems occurring in the prior art, and an object of the present invention is to provide a bag with an anti-theft function in which zippers can be locked to prevent valuables (a wallet, a cellular phone, a camera, a watch, etc.) stored in the bag from being stolen, and the whole bag can also be bound to a surrounding structure to prevent the whole bag from being stolen.

Another object of the present invention is to provide a bag with an anti-theft function which has relatively simple structure and operation principle and is configured such that water is prevented from permeating the bag, and if the zippers are forcibly unlocked without permission, an alarm is generated to arouse attention.

In order to accomplish the above object, the present invention provides a bag with an anti-theft function, the bag receiving and storing articles such as valuables therein and including: a bag body (11) having a storage space to receive the articles therein; tape (12) and (12') sewn to the bag body (11) at opposite sides of an opening of the bag body (11); zipper teeth (13) and (13') respectively attached to the tape (12) and (12'); a first zipper (14) including a slider (14-1) sliding along the zipper teeth (13) and (13') to couple or separate the zipper teeth (13) and (13') to or from each other, and a pull tab (14-2)

coupled to the slider (14-1), the pull tab (14-2) moving he slider (14-1) along the zipper teeth (13) and (13') to couple or separate the zipper teeth (13) and (13') to or from each other, with a coupling hole (14-2*a*) formed in the pull tab (14-2); a second zipper (15) comprising: a slider (15-1) sliding along the zipper teeth (13) and (13') to couple or separate the zipper teeth (13) and (13') to or from each other; and a pull tab (15-2) coupled to the slider (15-1), the pull tab (15-2) moving the slider (15-1) along the zipper teeth (13) and (13') to couple or separate the zipper teeth (13) and (13') to or from each other, with a coupling hole (15-2*a*) formed in the pull tab (15-2); and an anti-theft means (20) including a cable (21) to be bound at a first end thereof to a surrounding structure (1), a latch (22) passing through both the coupling holes (14-2*a*) and (15-2*a*) and fastening the pull tabs (14-2) and (15-2) to each other while the opening of the bag body (11) is closed and the pull tabs (14-2) and (15-2) are brought into close contact with each other in such a way that the coupling holes (14-2*a*) and (15-2*a*) are aligned with each other, and a locking unit (23) coupled to a second end of the cable 21, the locking unit (23) controlling locking or unlocking of the latch 22 to fasten or release the bag body (11) to or from the cable (21) bound to the surrounding structure (1).

Preferably, one of the pull tabs (14-2) and (15-2) has an L-shaped bent structure and the other has a reverse L-shaped bent structure such that when the pull tabs (14-2) and (15-2) make contact with each other in such a way that the coupling holes (14-2*a*) and (15-2*a*) are aligned with each other, surfaces of the pull tabs (14-2) and (15-2) that face each other can come into close contact with each other, with a coupling depression (14-2*b*) and a coupling protrusion (15-2*b*) provided on the surfaces of the pull tab (14-2) and (15-2) that face each other, the coupling depression (14-2*b*) and the coupling protrusion (15-2*b*) being coupled to each other when the pull tabs (14-2) and (15-2) make contact with each other.

Furthermore, the tape (12) and (12') and the zipper teeth (13) and (13') are made of non-conductive material, and the first and second zippers (14) and (15) are made of conductive material, wherein the bag further includes an alarm generation module (30) sensing current flowing through the first and second zippers (14) and (15) and generating an alarm depending on whether the coupling depression (14-2*b*) and the coupling protrusion (15-2*b*) are coupled to each other. The alarm generation module (30) is installed in a housing and provided in a waterproofed article receiving part provided in the bag body (11). The alarm generation module (30) includes a battery (31) supplying current to the first and second zippers (14) and (15), a current sensor (32) sensing current flowing through the first and second zippers (14) and (15), an alarm generating unit (33) generating an alarm depending on a sensing signal of the current sensor (32), and a switching unit (34) controlling operation of the alarm generation module (30).

The locking unit may include: a lock body (23-1); a rotating part (23-2), with the latch (22) installed in a front surface of the rotating part (23-2) so as to be extractable therefrom and retractable thereinto, the rotating part (23-2) mounted at a rear end thereof to the lock body (23-1) so as to be rotatable within a range from 90° to 360°, with the second end of the cable 21 coupled to a predetermined portion of the rotating part (23-2); a locking button (23-3) protruding outwards from an outer surface of the lock body (23-1), the locking button (23-3) connected at a portion thereof to the latch (22) inside the lock body (23-1) so that the latch (22) enters a locked state; a password input dial (23-4) rotatably installed in a periphery of the lock body (23-1), the password input dial (23-4) connected to the latch (22) inside the lock body (23-1) and having a three- or four-dial structure configured such that when an input password matches a preset password, the locked state of the latch (22) is released; and a password change button (23-5) provided on a rear surface of the lock body (23-1), the password change button (23-5) allowing a change of the password.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
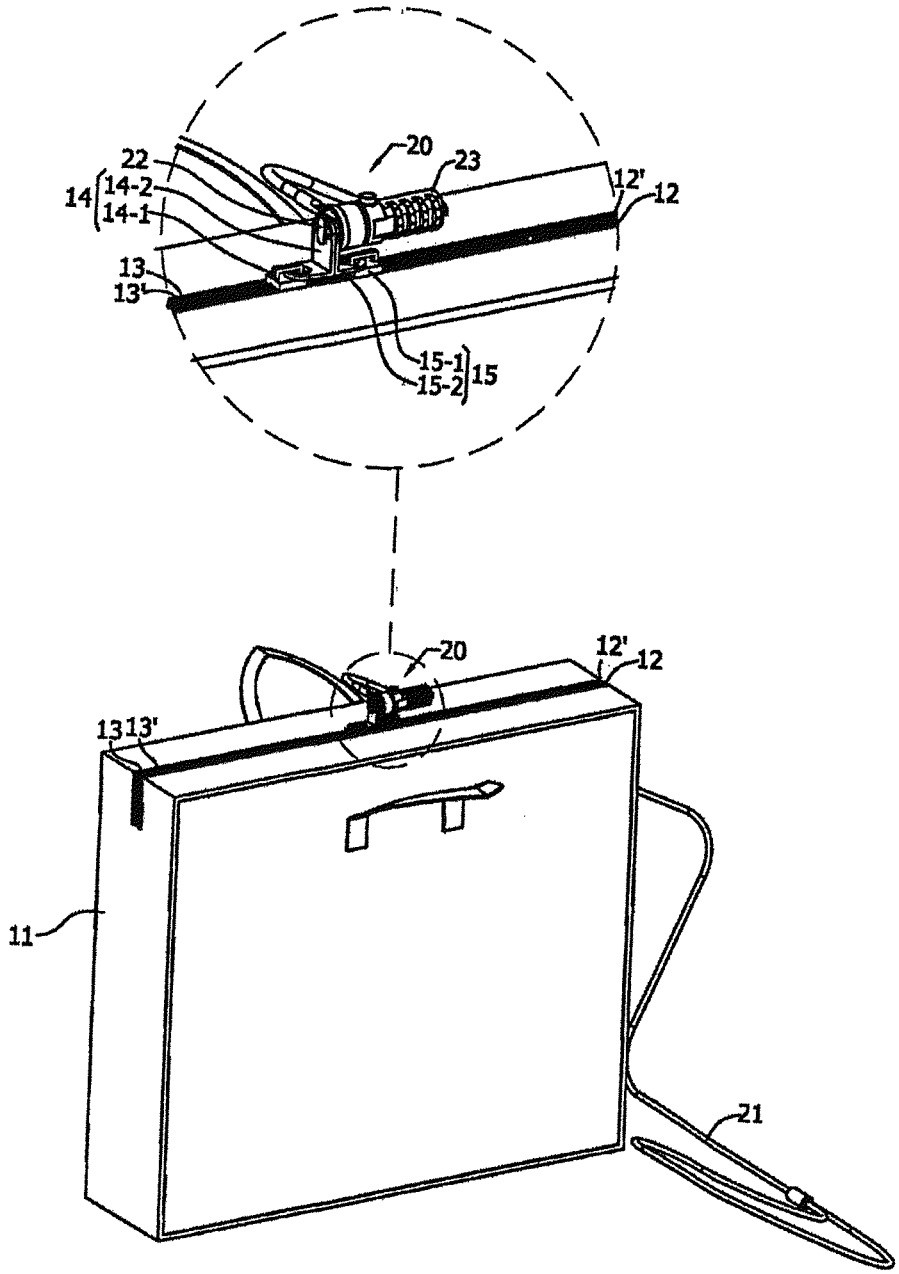
FIG. 1 is a perspective view illustrating a bag according to an embodiment of the present invention.

The following embodiments are only for illustrative purposes to enable those skilled in this art to easily understand the scope of the present invention. The scope of the present invention must be defined by the accompanying claims.

If in the specification, detailed descriptions of well-known functions or configurations would unnecessarily obfuscate the gist of the present invention, the detailed descriptions will be omitted.

The same reference numerals are used throughout the different drawings to designate the same or similar components. The terms and words used for elements in the description of the embodiments are disclosed only for illustrative purposes and should not be construed as limiting the present invention. The singular forms "a," "an" and "the" are intended to include the plural forms as well, unless the context clearly indicates otherwise. Also, when the explanatory phrase "a part includes a component" is used, this means that the part may further include other components rather than excluding the components, so long as special explanation is not given.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, a preferred embodiment of the present invention will be described in detail with reference to the attached drawings.

Figure 2:
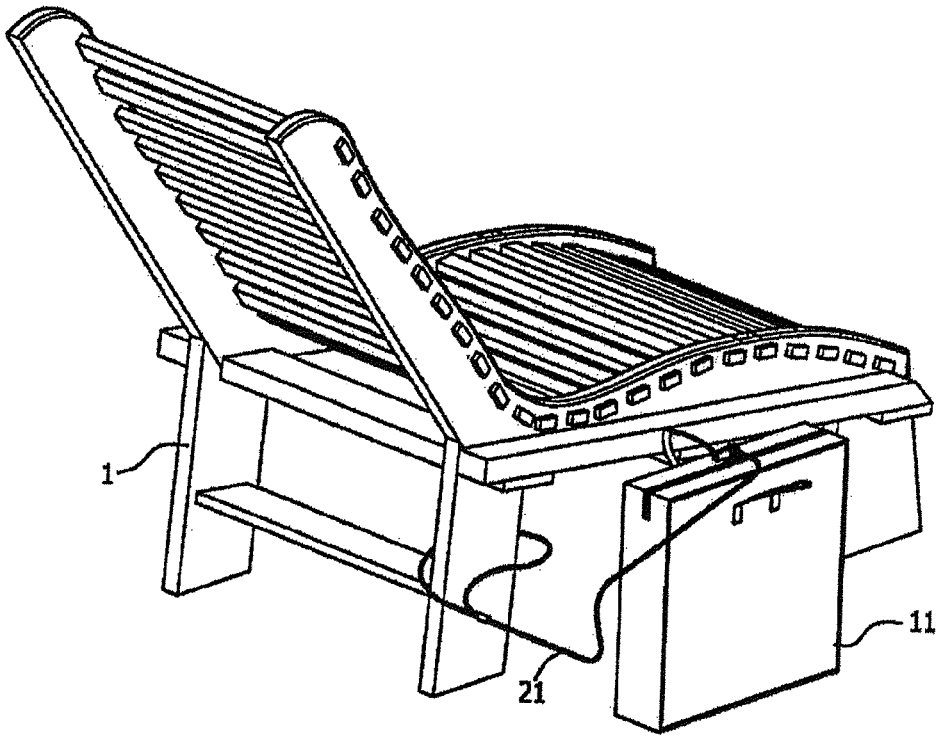
FIG. 2 is a perspective view illustrating the bag of FIG. 1 that is bound to a surrounding structure.

FIG. 1 is a perspective view illustrating a bag according to an embodiment of the present invention, and FIG. 2 is a perspective view illustrating the bag of FIG. 1 that is bound to a surrounding structure.

As shown in FIGS. 1 and 2, the bag according to an embodiment of the present invention is, for example, a bag for water play, and basically includes a bag body 11, tape 12 and 12', zipper teeth 13 and 13', first and second zippers 14 and 15 and an anti-theft means 20.

The bag body 11 provides a storage space which stores various kinds of valuables (for example, a wallet, a cellular phone, a camera, a watch, etc.), and clothes or the like for use in playing in the water. A plurality of separate article receiving parts may be provided in the bag body 11 so as to independently store valuables having various structures and shapes.

Each of the article receiving parts which are provided in the bag body 11 may be configured to be openably closed by a separate opening and closing member, for example, a zipper, Velcro tape or a snap fastener. A shock absorber, for example, a sponge, etc., may be installed in at least one of the article receiving parts so as to prevent articles that are received therein from being damaged.

To provide excellent portability, the bag body 11 has an inner liner and an outer shell which are made of relative light synthetic resin. Preferably, one of the inner liner and the outer shell is waterproofed with waterproof material, thus preventing water or excessive moisture from entering the bag body 11. The structure and the shape of the bag body 11 are not limited to special structure and shape.

The tape 12 and 12' are made of textile (fabric) material or synthetic resin. First edges of the tape 12 and 12' are respectively sewn with backstitches to opposite sides of the bag body 11 along an opening of the bag body 11. The zipper teeth 13 and 13' are respectively provided on second edges of the tape 12 and 12'.

The zipper teeth 13 and 13' are made of relatively hard metal or synthetic resin and are respectively coupled to the second edges of the tape 12 and 12'. The zipper teeth 13 and 13' are arranged at regular intervals. The zipper teeth 13 and 13' are respectively coupled to or separated from each other by sliding sliders 14-1 and 15-1 of the first and second zippers 14 and 15 towards or away from each other, thus closing or opening the opening of the bag body 11.

Stoppers (not shown) are respectively installed on both ends (fastening start points) of the zipper teeth 13 and 13'. Each stopper couples corresponding ends of the zipper teeth 13 and 13' to each other, thus preventing the slider 14-1 or 15-1 from being removed from the ends of the zipper teeth 13 and 13'.

FIGS. 3A and 3B are perspective views illustrating the structure of the first and second zippers according to the present invention. FIG. 3A is a perspective view of the first and second zippers when viewed from a first zipper side, and FIG. 3B is a perspective view of the first and second zippers when viewed from a second zipper side.

Referring to FIG. 3A, the first zipper 14 includes the slider 14-1 and a pull tab 14-2.

The slider 14-1 slides along the zipper teeth 13 and 13' to couple the zipper teeth 13 and 13' to each other or separate them from each other.

A first end of the pull tab 14-2 is rotatably coupled to a loop which is provided in an upper part of the slider 14-1. The pull tab 14-2 transmits force to the slider 14-1 and moves the slider 14-1 along the zipper teeth 13 and 13', thus coupling the zipper teeth 13 and 13' to each other or separating them from each other. A coupling hole 14-2*a* is formed in a second end of the pull tab 14-2 so that a latch 22 (refer to FIG. 1) of the anti-theft means 20 can be locked to the pull tab 14-2 through the coupling hole 14-2*a*.

Referring to FIG. 3B, the second zipper 15 is symmetrical to the first zipper 14. That is, the second zipper 15 includes the slider 15-1 and the pull tab 15-2 in the same manner as that of the first zipper 14.

The slider 15-1 slides along the zipper teeth 13 and 13' to couple the zipper teeth 13 and 13' to each other or separate them from each other.

A first end of the pull tab 15-2 is rotatably coupled to a loop which is provided in an upper part of the slider 15-1. The pull tab 15-2 moves the slider 15-1 along the zipper teeth 13 and 13' to couple the zipper teeth 13 and 13' to each other or separate them from each other. A coupling hole 15-2*a* is formed in a second end of the pull tab 15-2 so that the latch 22 (refer to FIG. 1) of the anti-theft means 20 is locked to the pull tab 15-2 through the coupling hole 15-2*a*.

As mentioned above, having the same structure, the first and second zippers 14 and 15 are symmetrical to each other. The direction in which the first zipper 14 moves to couple the zipper teeth 13 and 13' to each other or separate them from each other is opposite to that of the second zipper 14.

For example, if the first zipper 14 moves from the left to the right in FIG. 1, the zipper teeth 13 and 13' are coupled to each other, and if the first zipper 14 moves from the right to the left, the zipper teeth 13 and 13' are separated from each other. Contrary to the first zipper 14, if the second zipper 15 moves from the left to the right, the zipper teeth 13 and 13' are coupled to each other, and if the second zipper 15 moves from the right to left, the zipper teeth 13 and 13' are separated from each other. Therefore, each of the first and second zippers 14 and 15 can independently open or close the opening of the body bag 11.

As shown in FIGS. 3A and 3B, one of the pull tabs 14-2 and 15-2 of the first and second zipper 14 and 15 has an L-shaped bent structure and the other has a reverse L-shaped bent structure so that when the first and second zippers 14 and 15 make contact with each other and the coupling holes 14-2*a* and 15-2*a* face to each other, the surfaces of the pull tabs 14-2 and 15-2 that face each other can come into close contact with each other.

The reason why one of the pull tabs 14-2 and 15-2 has an L-shape and the other has a reverse L-shape is to facilitate the coupling of the latch 22 of the anti-theft means 20 to the pull tabs 14-2 and 15-2.

The bag according to the present invention is configured such that the first and second zippers 14 and 15 are locked to each other by the latch 22 of the anti-theft means 20, and the locked state is maintained so as to prevent the bag body 11 from being opened without permission and prevent various kinds of valuables that have been stored in the bag from being stolen.

As shown in FIG. 1, the latch 22 passes through both the coupling holes 14-2*a* and 15-2*a* of the pull tabs 14-2 and 15-2 illustrated in FIGS. 3A and 3B in a direction in response to locking or unlocking operation of a locking unit 23 and then linearly moves or rotates in a direction, thus locking the pull tabs 14-2 and 15-2 to each other or releasing them from each other.

The latch 22 comprises at least one linear bar shaped latch. In order that the latch 22 passes through both the coupling holes 14-2*a* and 15-2*a* of the pull tabs 14-2 and 15-2 and reliably linearly moves or rotates to lock the pull tabs 14-2 and 15-2 to each other or release them from each other, the pull tabs 14-2 and 15-2 must be brought into close contact with each other. For this reason, one of the pull tabs 14-2 and 15-2 has an L-shaped bent structure and the other has a reverse L-shaped bent structure.

Figure 4:
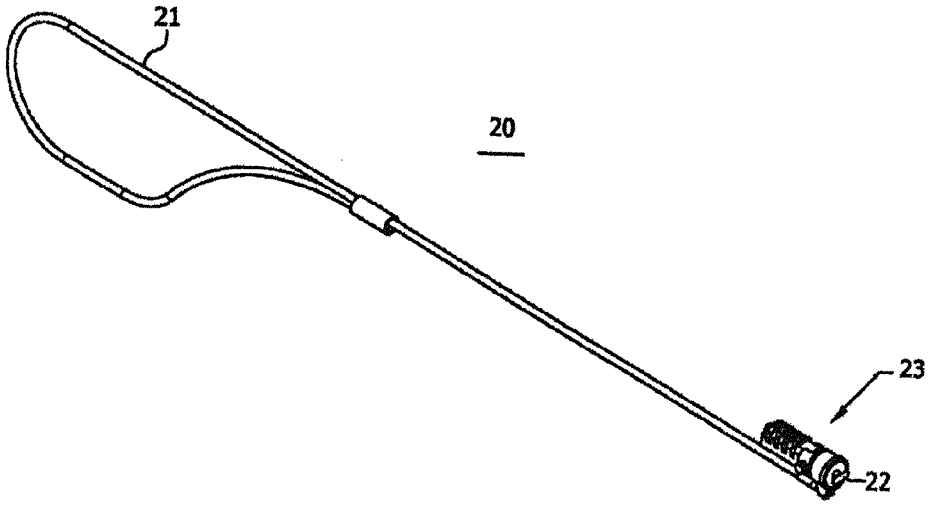
FIG. 4 is a perspective view illustrating an anti-theft means.

FIG. 4 is a perspective view illustrating the anti-theft means according to the present invention. FIG. 5A is a perspective view illustrating the locking unit when viewed from a password change button side, and FIG. 5B is a perspective view illustrating the locking unit when viewed from a latch side.

Figure 5:
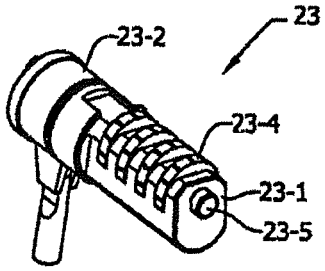
FIGS. 5A and 5B are perspective views illustrating a locking unit illustrated in FIG. 4.
Figure 5:
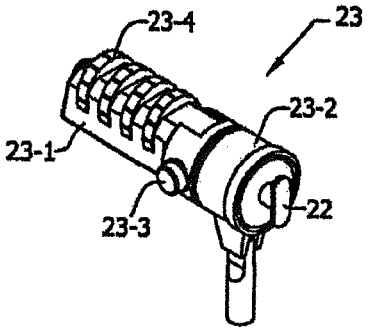

Referring to FIGS. 4 and 5, the anti-theft means 20 according to the prevent invention includes a cable 21, the latch 22 and the locking unit 23. The locking unit 23 includes a lock body 23-1, a rotating part 23-2, a locking button 23-3, a password input dial 23-4 and the password change button 23-5.

A first end of the cable 21 is bound to a surrounding structure 1, and a second end thereof is coupled to the rotating part 23-2 of the locking unit 23. In order that the cable 21 can be simply bound to the surrounding structure 1 (refer to FIG. 2), a loop is provided on the first end of the cable 21. The cable 21 can be bound to the surrounding structure 1 in such a way that the second end of the cable 21 passes through the loop with being wound around the surrounding structure 1 as if a knot was formed on the cable 21.

Preferably, the cable is formed by twisting strong wires inside thereof so as not to be easily cut. Made of relatively soft synthetic resin, an outer protective shell covers the twisted wires.

The locking unit 23 is coupled to the second end of the cable 21 and controls the locking or unlocking of the latch 22 to fasten the bag body 11 to the cable 21 bound to the surrounding structure 1 or release the bag body 11 from the cable 21.

The locking unit 23 having the above-mentioned function includes the lock body 23-1, the rotating part 23-2, the locking button 23-3, the password input dial 23-4 and the password change button 23-5, as stated above.

The latch 21 is installed in a front surface of the rotating part 23-2 so as to be extractable therefrom and retractable thereinto. The rotating part 23-2 is coupled at a rear end thereof to the lock body 23-1 so as to be rotatable within a range from 90° to 360°.

The second end of the cable 21 is coupled to a predetermined portion of the rotating part 23-2 so that the cable 21 can rotate in conjunction with the rotation of the rotating part 23-2. Thereby, regardless of the structure or location of the surrounding structure 1, the cable 21 can be easily bound to the surrounding structure 1.

The locking button 23-3 protrudes outwards from the lock body 23-1. Disposed in the lock body 23-1, a portion of the locking button 23-3 is connected to the latch 22 so that the latch 22 that has been coupled to the pull tabs 14-2 and 15-2 through the coupling holes 14-2*a* and 15-2*a* can be maintained in a locked state.

Connected to the locking button 23-3, the latch 22 linearly moves or rotates in response to manipulation of the locking button 23-3, thus entering the locked state. That is, after the latch 22 has passed through the coupling holes 14-2*a* and 15-2*a* of the pull tabs 14-2 and 15-2, when a user pushes the locking button 23-3, the latch 22 linearly moves or rotates in conjunction with the locking button 23-3, whereby the latch 22 can be reliably locked to the pull tabs 14-2 and 15-2.

Figure 6:
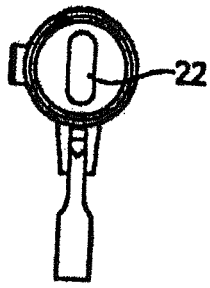
FIGS. 6A and 6B are views illustrating locking and unlocking operations of a latch of the locking unit according to the prevent invention.
Figure 6:
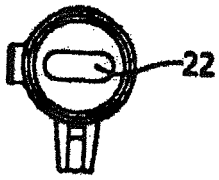

FIGS. 6A and 6B are views illustrating the locking and unlocking operations of the latch of the locking unit according to the prevent invention. FIG. 6A is a view showing the unlocked state of the latch. FIG. 6B is a view showing the locked state of the latch.

Referring to FIGS. 6A and 6B, in an embodiment, the latch 22 may have a single linear-bar-shaped latch structure. In the structure of FIGS. 6A and 6B, the latch is oriented in the vertical direction at an initial stage of the unlocked state. In this state, if the locking button 23-3 is pushed, the latch 22 rotates by 90° in conjunction with the operation of the locking button 23-3, thus entering the locked state.

The password input dial 23-4 is rotatably installed in the periphery of the lock body 23-1 and is connected to the latch 22 inside the lock body 23-1. In this embodiment, the password input dial 23-4 has a three- or four-dial structure configured such that when a password input by means of the dials matches a preset password, the locked state of the latch 22 is released. For example, in a four-dial structure, 10,000 passwords can be produced by combination of four dials.

Allowing a change of the preset password, the password change button 23-5 is installed in a rear surface of the lock body 23-1. In other words, the existing password can be changed into a new password in such a way that the user individually rotates the password input dials 23-4 with the password change button 23-5 being pushed and then sets the desired password.

FIGS. 7A and 7B are perspective views illustrating first and second zippers according to another embodiment of the present invention. FIG. 7A is a perspective view of the first and second zippers when viewed from a first zipper side, and FIG. 7B is a perspective view of the first and second zippers when viewed from a second zipper side.

Referring to FIGS. 7A and 7B, the first and second zippers 14 and 15 according to this embodiment further include a coupling depression 14-2*b* and a coupling protrusion 15-2*b* which are respectively provided on surfaces of the pull tabs 14-2 and 15-2 that face each other.

In this embodiment, the coupling depression 14-2*b* is formed in the pull tab 14-2 of the first zipper 14, and the coupling protrusion 15-2*b* is provided on the pull tab 15-2 of the second zipper 15. Here, the coupling depression 14-2*b* and the coupling protrusion 15-2*b* may have a snap fastener structure configured such that when the pull tabs 14-2 and 15-2 come into close contact with each other, the coupling protrusion 15-2*b* is fitted into the coupling depression 14-2*b* so that the pull tabs 14-2 and 15-2 can be coupled to each other.

In this case, the coupling depression 14-2*b* formed in the pull tab 14-2 and the coupling protrusion 15-2*b* provided on the pull tab 15-2 may also function as a switching device which can make an alarm sound to let the user know whether the pull tabs 14-2 and 15-2 are coupled to or separated from each other.

To achieve the above-mentioned purpose, the first and second zippers 14 and 15, that is, the pull tabs 14-2 and 15-2, the coupling depression 14-2*b*, the coupling protrusion 15-2*b* and the sliders 14-1 and 15-1, are made of conductive material through which electricity can flow, while the tab 12 and 12' and the zipper teeth 13 and 13' are made of non-conductive material.

Figure 8:
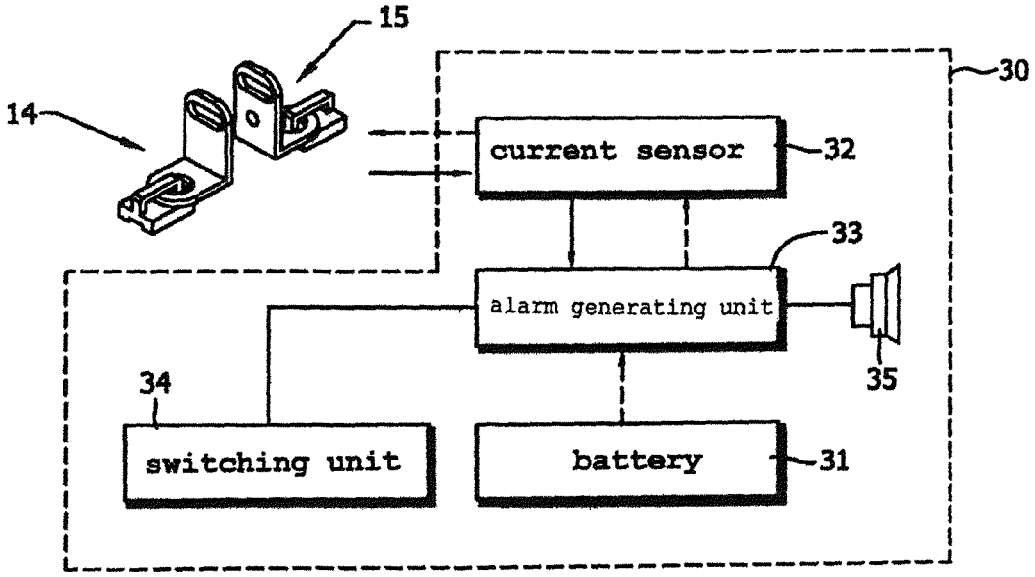
FIG. 8 is a block diagram showing an alarm generation module according to the present invention.

FIG. 8 is a block diagram showing an alarm generation module according to the present invention.

Figure 7:
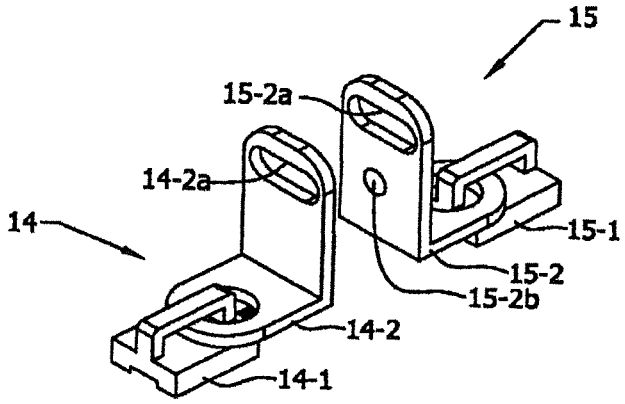
FIGS. 7A and 7B are perspective views illustrating first and second zippers according to another embodiment of the present invention.
Figure 7:
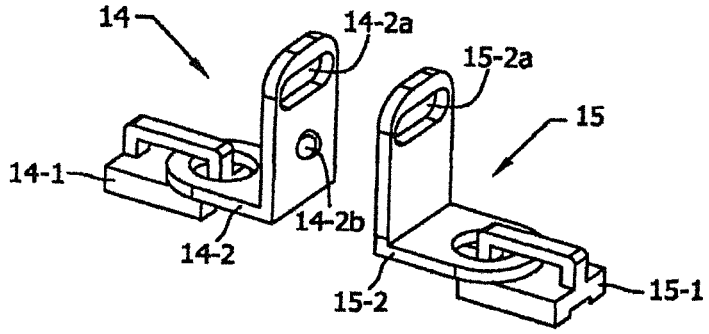

Referring to FIGS. 7 and 8, the bag according to the present invention may further include an alarm generation module 30 which generates an alarm sound depending on whether the coupling protrusion 15-2*b* is coupled to the coupling depression 14-2*b*.

The alarm generation module 30 senses current which flows through the first and second zipper 14 and 15 and generates an alarm sound depending on whether the coupling protrusion 15-2*b* is coupled to the coupling depression 14-2*b*.

The alarm generation module 30 is provided in a housing (not shown) that is installed in the bag body 11 (refer to FIG. 1). Particularly, the alarm generation module 30 is disposed in the article receiving part that is provided in the bag body 11 and is waterproofed. Preferably, the alarm generation module 30 includes a battery 31, a current sensor 32, an alarm generating unit 33 and a switching unit 34.

The battery 31 is an internal power supply which may be a disposable battery or a rechargeable battery to supply power to the alarm generation module 30. Supplying current to the first and second zippers 14 and 15, the battery 31 is electrically connected to the first and second zippers 14 and 15 through electric cables (not shown) which are installed between the inner liner and the outer shell of the bag body 11.

For example, the first zipper 14 is electrically connected to the positive pole (+) of the battery 31, and the second zipper 15 is electrically connected to the negative pole (−) of the battery 31 and vice versa.

Preferably, electrically connecting the battery 31 to the first and second zippers 14 and 15, the electric cables are electrically connected to the sliders 14-1 and 15-1 of the first and second zipper 14 and 15

Here, the electric cables have sufficient lengths to enable the sliders 14-1 and 15-1 to slide along the zipper teeth 13 and 13'. In addition, the electric cables are preferably made of relatively thin flexible conductive wire, thus making it possible for the electric cables to unrestrictedly move in space between the inner liner and the outer shell of the bag body 11 in conjunction with the movement of the sliders 14-1 and 15-1. Thereby, the distance that the sliders 14-1 and 15-1 can slide is not affected by the electric cables.

The current sensor 32 senses in real time current that flows through the first and second zippers 14 and 15 and then transmits a sensing signal to the alarm generating unit 33.

The alarm generating unit 33 generates an alarm sound through a speaker in response to the sensing signal transmitted from the current sensor 32, thus arousing attention. For example, if the sensing signal is a signal that indicates that the coupling depression 14-2*b* and the coupling protrusion 15-2*b* of the pull tabs 14-2 and 15-2 are coupled to each other and current thus flows through the first and second zipper 14 and 15, the alarm generating unit 33 generates no alarm sound. If the sensing signal is a signal that indicates that the coupling depression 14-2*b* and the coupling protrusion 15-2*b* of the pull tabs 14-2 and 15-2 are separated from each other and current is thus interrupted between the first and second zipper 14 and 15, the alarm generating unit 33 generates an alarm sound through the speaker.

The switching unit 34 turns on/off the alarm generating unit 33, that is, the alarm generation module 30, depending on whether an alarm mode is on or off, thus preventing unnecessary consumption of the battery 31. In other words, when the switching unit 34 is turned off, the alarm generation module 30 is not in operation. Only when the switching unit 34 is turned on can the alarm generation module 30 be operated so that an alarm sound can be generated.

Figure 9:
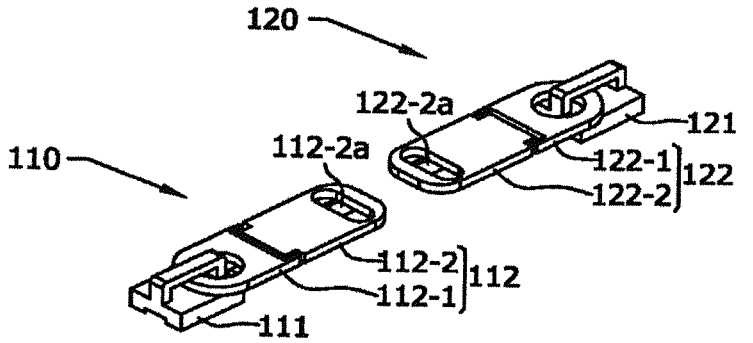
FIGS. 9A and 9B are perspective views illustrating first and second zippers according to a further embodiment of the present invention.
Figure 9:
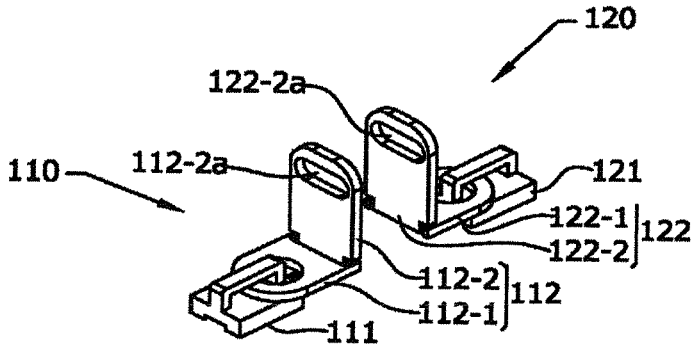

FIGS. 9A and 9B are perspective views illustrating first and second zippers according to a further embodiment of the present invention. FIG. 9A is a view showing the first and second zippers that horizontally spread out, and FIG. 9B is a view showing the first and second zippers, portions of which are vertically bent.

Referring to FIGS. 9A and 9B, the pull tabs of the first and second zippers 110 and 120 according to this embodiment have a different structure from that of the first and second zippers 14 and 15 illustrated in FIGS. 3A and 3B.

That is, each of the pull tabs 112 and 122 of the first and second zippers 110 and 120 includes a connection piece 112-1, 122-1 which is coupled to the slider 111, 121, and a fastening piece 112-2, 122-2 which is coupled to the connection piece 112-1, 122-1 so as to be vertically rotatable.

Figure 3:
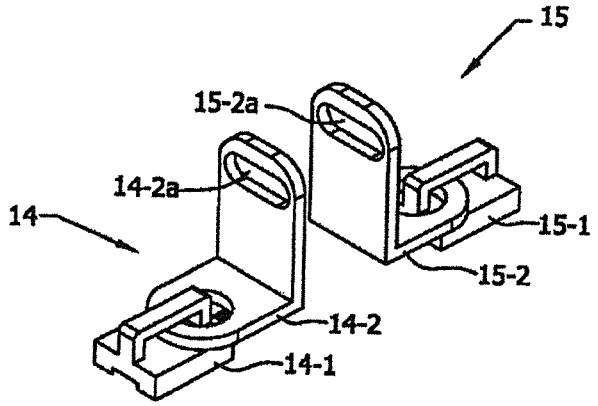
FIGS. 3A and 3B are perspective views illustrating the structure of first and second zippers according to the present invention.
Figure 3:
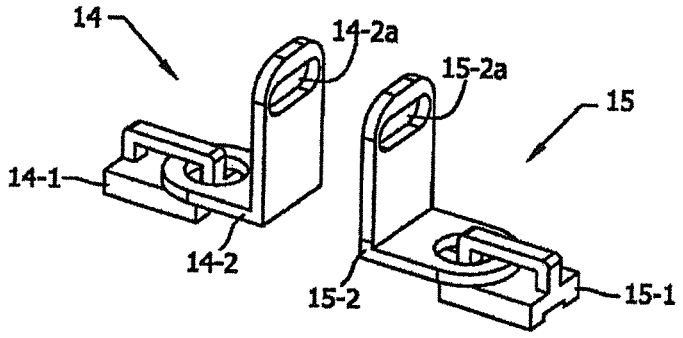

In the same manner as the first and second zippers 14 and 15 of FIG. 3, the fastening pieces 112-1 and 122-1 respectively have coupling holes 112-2*a* and 122-2*a* through which the latch 22 (refer to FIG. 5) of the anti-theft means 20 passes to lock the first and second zippers 110 and 120 to each other.

As shown in FIG. 9A, under normal conditions, the pull tabs 112 and 122 of the first and second zippers 110 and 120 are horizontally oriented parallel to the tab (12 and 12', refer to FIG. 1).

In this state, to couple and lock the first and second zippers 110 and 120 to each other using the latch of the anti-theft means 20, as shown in FIG. 9B, the fastening pieces 112-1 and 122-2 are vertically bent from the connection pieces 112-1 and 122-1 so that the coupling holes 112-2*a* and 122-2*a* are aligned with each other. After the cable 21 has been bound to the surrounding structure 1, the latch 22 passes through both the coupling holes 112-2*a* and 122-2*a*, and the locking button 23-3 is manipulated to fasten the pull tabs 112 and 122 to each other whereby the first and second zippers 110 and 120 can be prevented from being undesirably separated from each other.

Hereinafter, the function of the bag according to the present invention will be described in detail.

After the first and second zippers 14 and 15 are moved towards each other to close the opening of the bag body 11, the pull tabs 14-2 and 15-2 come into close contact with each other so that the coupling holes 14-2*a* and 15-2*a* are aligned with each other. Thereafter, with the cable 21 being bound to the surrounding structure 1, the latch 22 passes through both the coupling holes 14-2*a* and 15-2*a*, and the locking button 23-3 is pushed whereby the pull tabs 14-2 and 15-2 are fastened to each other such that they are prevented from being undesirably separated from each other.

Here, the pull tabs 14-2 and 15-2 are coupled to each other by the coupling depression 14-2*b* and the coupling protrusion 15-2*b* that are respectively provided on the surfaces of the pull tabs 14-2 and 15-2 that face each other. Furthermore, the pull tabs 14-2 and 15-2 are locked to each other by the latch 22 whereby the bag body 11 is maintained in the locked state with the opening closed and is bound to the surrounding structure 1 by the cable 21 of the anti-theft means 20. Thereby, an unauthorized person can be fundamentally prevented from fleeing with the whole bag body 11.

Furthermore, in the bag according to the present invention, if the coupling depression 14-2*b* and the coupling protrusion 15-2*b* of the pull tabs 14-2 and 15-2 are separated from each other by an unauthorized person, the alarm generation module 30 provided in the bag body 11 senses this and generates an alarm sound in real time, thus warning the unauthorized person who is attempting to steal the bag, thereby deterring the thief.

Although the bag for water play has been illustrated as being one example of the bag with an anti-theft function according to the present invention, the present invention is not limited to the bag for water play. In other words, the present invention can be applied to any bag regardless of the kind or purpose, so long as the bag has an article storage function.

As described above, the present invention provides a bag with an anti-theft means which fastens first and second zippers for use in openably closing an opening of the bag body to each other and binds the bag body to a surrounding structure. Therefore, the present invention can prevent valuables, e.g., a wallet, a cellular phone, a camera, a watch, etc., stored in the bag body from being stolen. In addition, because the bag is bound to the surrounding structure, the whole bag can be prevented from being stolen.

Furthermore, in the present invention, pull tabs of the first and second zippers, which openably close the opening of the bag body, are configured in such a way that one of them has an L-shaped bent structure and the other has a reverse L-shaped bent structure so that the pull tabs can come into close contact with each other. Thereby, a latch of the anti-theft means that passes through the coupling holes of the pull tabs can be more easily coupled to the pull tabs.

In addition, the bag according to the present invention further includes an alarm generation module. Thus, when a coupling depression and a coupling protrusion which are respectively provided on the pull tabs of the first and second zippers are forcibly separated from each other by an unauthorized person, the alarm generation module senses this and generates an alarm sound in real time, thus warning the unauthorized person who is attempting to steal the bag, thereby deterring the thief.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bag with an anti-theft function, the bag receiving and storing articles including valuables therein and comprising:

a bag body (11) having a storage space to receive the articles therein;

tape (12) and (12') sewn to the bag body (11) at opposite sides of an opening of the bag body (11);

zipper teeth (13) and (13') respectively attached to the tape (12) and (12');

a first zipper (14) comprising: a slider (14-1) sliding along the zipper teeth (13) and (13') to couple or separate the zipper teeth (13) and (13') to or from each other; and a pull tab (14-2) coupled to the slider (14-1), the pull tab (14-2) moving the slider (14-1) along the zipper teeth (13) and (13') to couple or separate the zipper teeth (13) and (13') to or from each other, with a coupling hole (14-2*a*) formed in the pull tab (14-2);

a second zipper (15) comprising: a slider (15-1) sliding along the zipper teeth (13) and (13') to couple or separate the zipper teeth (13) and (13') to or from each other; and a pull tab (15-2) coupled to the slider (15-1), the pull tab (15-2) moving the slider (15-1) along the zipper teeth (13) and (13') to couple or separate the zipper teeth (13) and (13') to or from each other, with a coupling hole (15-2*a*) formed in the pull tab (15-2); and an anti-theft means (20) comprising: a cable (21) to be bound at a first end thereof to a surrounding structure (1); a latch (22) passing through both the coupling holes (14-2*a*) and (15-2*a*) and fastening the pull tabs (14-2) and (15-2) to each other while the opening of the bag body (11) is closed and the pull tabs (14-2) and (15-2) are brought into close contact with each other in such a way that the coupling holes (14-2*a*) and (15-2*a*) are aligned with each other; and a locking unit (23) coupled to a second end of the cable 21, the locking unit (23) controlling locking or unlocking of the latch 22 to fasten or release the bag body (11) to or from the cable (21) bound to the surrounding structure (1), wherein one of the pull tabs (14-2) and (15-2) has an L-shaped bent structure and the other has a reverse L-shaped bent structure such that when the pull tabs (14-2) and (15-2) make contact with each other in such a way that the coupling holes (14-2*a*) and (15-2*a*) are aligned with each other, surfaces of the pull tabs (14-2) and (15-2) that face each other can come into close contact with each other, with a coupling depression (14-2*b*) and a coupling protrusion (15-2*b*) provided on the surfaces of the pull tab (14-2) and (15-2) that face each other, the coupling depression (14-2*b*) and the coupling protrusion (15-2*b*) being coupled to each other when the pull tabs (14-2) and (15-2) make contact with each other, the tape (12) and (12') and the zipper teeth (13) and (13') are made of non-conductive material, and the first and second zippers (14) and (15) are made of conductive material, wherein the bag further comprises an alarm generation module (30) sensing current flowing through the first and second zippers (14) and (15) and generating an alarm depending on whether the coupling depression (14-2*b*) and the coupling protrusion (15-2*b*) are coupled to each other, the alarm generation module (30) installed in a housing and provided in a waterproofed article receiving part provided in the bag body (11), the alarm generation module (30) comprising:

a battery (31) supplying current to the first and second zippers (14) and (15);

a current sensor (32) sensing current flowing through the first and second zippers (14) and (15);

an alarm generating unit (33) generating an alarm depending on a sensing signal of the current sensor (32); and a switching unit (34) controlling operation of the alarm generation module (30).

2. The bag as set forth in claim 1, wherein the locking unit comprises:

a lock body (23-1);

a rotating part (23-2), with the latch (22) installed in a front surface of the rotating part (23-2) so as to be extractable therefrom and retractable thereinto, the rotating part (23-2) mounted at a rear end thereof to the lock body (23-1) so as to be rotatable within a range from 90° to 360°, with the second end of the cable 21 coupled to a predetermined portion of the rotating part (23-2);

a locking button (23-3) protruding outwards from an outer surface of the lock body (23-1), the locking button (23-3) connected at a portion thereof to the latch (22) inside the lock body (23-1) so that the latch (22) enters a locked state;

a password input dial (23-4) rotatably installed in a periphery of the lock body (23-1), the password input dial (23-4) connected to the latch (22) inside the lock body (23-1) and having a three- or four-dial structure configured such that when an input password matches a preset password, the locked state of the latch (22) is released; and a password change button (23-5) provided on a rear surface of the lock body (23-1), the password change button (23-5) allowing a change of the password.

* * * * *